United States Patent [19]

Meyer

[11] Patent Number: 4,593,340

[45] Date of Patent: Jun. 3, 1986

[54] IGNITER WITH IMPROVED INSULATOR SUPPORT

[75] Inventor: Helmut P. Meyer, Jacksonville, Fla.

[73] Assignee: Allied Corporation, Morristown, N.J.

[21] Appl. No.: 765,299

[22] Filed: Aug. 13, 1985

[51] Int. Cl.[4] ..... F23Q 3/00

[52] U.S. Cl. ..... 361/253; 123/169 EL; 431/264

[58] Field of Search ..... 361/253; 431/264; 123/169 R, 169 EL

[56] References Cited

U.S. PATENT DOCUMENTS 4,309,738 1/1982 Mulkins et al. ..... 361/253

FOREIGN PATENT DOCUMENTS 884904 12/1961 United Kingdom ..... 123/169 R

*Primary Examiner*—Donald A. Griffin

*Attorney, Agent, or Firm*—Bruce L. Lamb; Robert M. Trepp

[57] ABSTRACT

A spark discharge igniter for gas turbine engines and the like. The igniter includes a tubular metal shell and a relatively long ceramic insulator inserted in the shell and rigidly secured to the shell near one end thereof. A metal collar is fitted tightly between the insulator and shell at the end opposite the rigidly secured end. The collar is initially in the form of a split ring installed on the insulator prior to assembly of the insulator into the shell. The ring is extruded into the tightly fitting collar in the course of inserting the insulator into the shell.

8 Claims, 3 Drawing Figures

IGNITER WITH IMPROVED INSULATOR SUPPORT

The present invention relates to igniters for gas turbine engines. More particularly, it relates to an igniter having an improved insulator supporting structure.

BACKGROUND OF THE INVENTION

An igniter plug for a gas turbine engine conventionally comprises a tubular metal shell enclosing a ceramic insulator which, in turn, supports a metallic central electrode. A firing gap is formed between the tip of the central electrode and the periphery of the shell surrounding the electrode tip. The large difference between the thermal coefficients of expansion for ceramic material and for metal is a source of pernicious problems in such devices because of the high temperature ranges through which they must operate. The ceramic insulator cannot be secured at both ends of the shell since expansion of the shell would cause fracture of the insulator. When the insulator is secured to the shell at only one end, usually the end opposite the firing gap, expansion of the shell leads to undesirable changes in the configuration of the igniter at the firing gap.

To preserve the firing gap configuration in relatively long igniter plugs operating through wide temperature ranges it is current practice to form the electrical insulation thereof in two sections which are coaxially fitted together over a portion of their lengths. A shorter insulator section envelopes a portion of the end of a longer insulator section. The shorter insulator section is secured to the shell near the firing gap tip, while the longer insulator section is secured to the shell near the end opposite the firing gap, which opposite end is designed to mate with a connector for an ignition cable supplying electrical energy to the igniter. The disparate expansion rates of the shell and the insulator materials can then be accommodated without undesirable variation in the gap electrode configuration and without fracture of the insulator materials by the freedom of movement afforded by having the end portion of one insulator section telescope within the other insulator section. An example of an igniter having such telescoping insulator sections appears in U.S. Pat. No. 4,309,738, issued Jan. 5, 1982 to Mulkins et al. for Igniter Plug.

In the igniter plug described in the above referenced patent, fused glass seals are formed between the insulator and shell and between the insulator and central electrode near the connector end of the shell to prevent leakage of gases from the engine combustion chamber through the igniter plug. Although the insulator may be fitted relatively tightly within the shell when the igniter is assembled at ordinary ambient temperature, elevation of the igniter temperature to the high level encountered in use causes radial as well as lengthwise expansion of the shell. At operating temperature the major portion of the length of the longer section of the insulator is unsupported within the shell. Engine vibration transmitted through the unsupported length of the insulator then can cause cracking of the insulator near the supported end thereof or fracture of the glass seals formed in the vicinity of such supported end.

It is an object of the present invention to provide an igniter having a metal shell and a relatively long ceramic insulator with means effective at elevated temperature for supporting both ends of the insulator within the shell.

It is another object of the invention to provide an igniter having a metal shell and a ceramic insulator with means for supporting the insulator near both ends thereof so designed that thermal expansion of the shell will not exert damaging stress upon the insulator.

It is still another object of the invention to provide an igniter having a metal shell and a ceramic insulator with a metal supporting ring at the forward end of the insulator which is extruded into a tightly fitting conformal collar by the process of assembling the insulator within the shell.

Other objects and advantages of the invention will become apparent as an understanding thereof is gained through study of the following detailed description and accompanying drawings.

BRIEF DESCRIPTION

The igniter of the invention comprises a tubular metal shell enclosing a relatively long ceramic insulator with a center electrode extending axially therethrough. The diameter of the insulator through the major portion of its length is generally such as to provide clearance between the outer surface of the insulator and the inner surface of the shell. Near the forward end of the insulator along a portion of the length of the insulator, the diameter is enlarged to provide a close sliding fit between the enlarged diameter insulator portion and the major portion of the length of the shell. The internal diameter of the shell is enlarged near the connector end of the shell. This enlarged diameter portion of the shell transitions through a short length tapered section to the smaller uniform diameter prevailing through the major portion of the length of the shell.

A circumferential groove is formed in the enlarged diameter insulator portion. A split ring of malleable metal is positioned in the insulator groove prior to assembly of the insulator to the shell. The ring is sized to contact the shell wall at the entrance to the tapered transition section. The insulator is assembled to the shell by passing the forward end of the insulator into the shell, which movement occurs freely until the ring mounted in the insulator groove encounters the tapered diameter section of the shell. Thereafter forward movement of the insulator into the shell is continued with the aid of a press until the insulator is engaged in the shell. In passing through the tapered portion of the shell into the smaller uniform diameter portion thereof the metal ring is extruded into a tightly fitted collar which closely conforms to the inner wall of the shell and the outer surface of the insulator. Lateral supporting means are thereby provided at the forward end of the insulator which do not exert any substantial stress upon the insulator as a result of thermal expansion of the shell.

DETAILED DESCRIPTION

Figure 1:
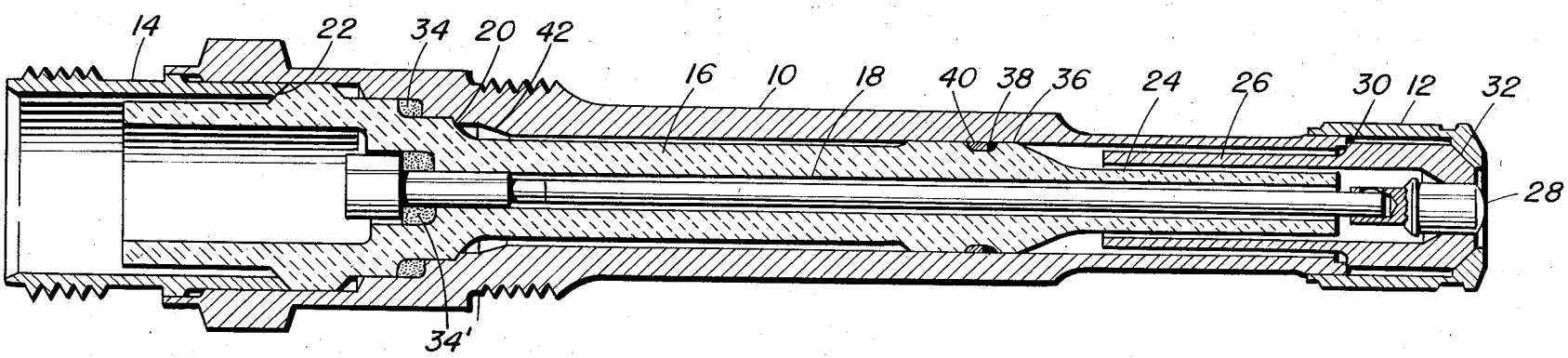
FIG. 1 is a longitudinal section of an igniter incorporating the improved insulator support means of the invention.

FIG. 1 illustrates an igniter, generally of known construction, incorporating the improved insulator supporting means of the invention. The igniter comprises a tubular metal shell formed of a main body portion 10, a tip portion 12 and a connector portion 14. Shell portions 10 and 14 enclose a stepped diameter, ceramic insulator 16. Insulator 16 supports a center electrode 18 extending axially therethrough. Insulator 16 is secured within the shell body portion 10 by a forward tapered shoulder 20, which abuts against a conforming internal surface of shell body 10 and by a rear tapered shoulder 22 in abutment with the forward tapered end of shell portion 14. The forward length of shell portion 14 extends within body portion 10 as a closely fitted internal sleeve. After seating the shoulder 20 against the conforming internal surface of shell body 10, shell portion 14 is pressed into engagement with shoulder 22 and then welded to the shell body 10.

The forward portion 24 of insulator 16 is of reduced diameter for telescoping within a hollow, cylindrical, ceramic insulator 26. A metal tip 28 is formed of an alloy resistant to spark erosion is welded to the forward end of center electrode 18. Insulator 26 is secured within the tip portion 12 of the shell body by a rear shoulder 30 held in abutment with the forward end of shell body 10 by pressure applied to the frusto-conical insulator end face 32 through a mating internal surface of shell portion 12. Tip portion 12 is welded to body portion 10 after placement of insulator 26. Fuzed glass seals 34, 34' are formed between the insulator and the shell and between the central electrode and the insulator towards the rear of the igniter to prevent leakage of gases from the engine combustion chamber through the igniter.

As thus far described, the igniter of FIG. 1 is of known construction. The improved insulator support means of the invention comprises the enlarged diameter insulator portion 36 adjacent forward insulator portion 24. A circumferential groove 38 is formed in insulator portion 36. A metal collar 40 carried in groove 38 tightly encircles insulator 16 and tightly contacts the inner wall of shell body 10 to provide support for insulator 16 near the forward end thereof. The inner diameter of shell body 10 transitions from a larger value in the vicinity of shoulder 20 to a smaller uniform value which prevails through the forward length through a tapered convergent section 42.

Figure 3:
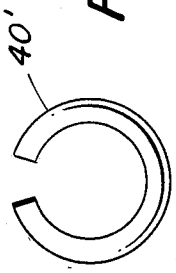
FIG. 3 is an elevation of the split metal support ring prior to assembly to the insulator.
Figure 2:
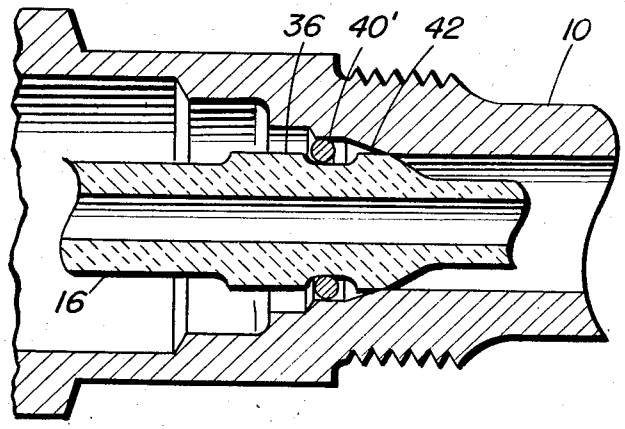
FIG. 2 is a partial sectional view of the igniter showing the relationship of the shell, insulator and support ring during assembly.

Referring to FIGS. 2 and 3, collar 40 is initially in the form of a split metal ring 40' of circular cross-section. Ring 40' may be composed of copper, soft annealed nickel or other soft ductile metal. Insulator portion 36 is sized to fit closely within the forward portion of shell of body 10 at ambient temperature. The cross-sectional diameter of ring 40 is sized to contact the inner wall of shell body 10 at the entrance end of convergent section 42. Ring 40' is installed in groove 38 prior to assembly of insulator 16 to shell body 10. In assembling the insulator to the shell, the insulator is passed forward into the shell, as indicated by the arrow of FIG. 2, until ring 40' encounters convergent section 42. Forward motion of the insulator into the shell is then continued with the aid of a press. In passing through convergent section 42, ring 40' is extruded into the oblate cross-sectional form shown for collar 40 in FIG. 1.

In the assembled igniter, collar 40 supports the forward end of the insulator 16 against lateral movement without constraining relative longitudinal movement between the insulator and shell due to thermal expansion. Obviously, the invention may be practiced otherwise than as specifically disclosed without departing from the spirit and scope of the appended claims.

The invention claimed is:

1. In an igniter having a tubular metal shell, a ceramic insulator inserted longitudinally into said shell and enclosed thereby and a center electrode extending axially through said insulator, said insulator being secured to said shell adjacent one end of said insulator; improved means for supporting said insulator within said shell comprising, a metal collar substantially encircling said insulator adjacent the end thereof opposite the end of said insulator secured to said shell, said collar having an oblate cross sectional form with one surface thereof closely contacting the outer surface of said insulator and with another surface thereof closely contacting the inner surface of said shell, said collar being substantially in the form of a ring initially having an outer diameter greater than the inner diameter of said shell at the location within said shell of said collar when said insulator is inserted fully into said shell, said ring being extruded into said collar of oblate cross-sectional form in the course of inserting said insulator within said shell.

2. The improvement of claim 1 wherein said insulator includes an enlarged diameter portion adjacent said collar, said enlarged diameter being of sufficient size to prevent displacement of said collar relative to said insulator in the direction opposite to the direction of insertion of said insulator into said shell.

3. The improvement of claim 2 wherein said enlarged diameter portion of said insulator includes a circumferential groove and wherein said collar is fitted in said groove.

4. The improvement of claim 3 wherein said collar is initially in the form of a split ring fitted in said groove of said enlarged diameter insulator portion prior to insertion of said insulator into said shell.

5. A spark discharge igniter improved insulator supporting means comprising, a tubular metal shell having a forward end and a rearward end, a first portion of the interior of said shell adjacent rearward end thereof being formed with a first internal diameter, a second portion of the interior of said shell adjacent said forward end thereof being formed with a second internal diameter smaller than said first internal diameter, a third portion of the interior of said shell joining said first portion to said second portion being formed with a tapering internal diameter which converges along the length of said third portion from said first internal diameter to said second internal diameter, a ceramic insulator inserted in said shell in the direction proceeding from said rearward end of said shell towards said forward end thereof, said insulator having a first insulator portion at the forward end thereof of a first diameter smaller than said second diameter of said second shell portion and a second insulator portion adjacent said first insulator portion and of a second diameter larger than said first insulator portion diameter;

a metal collar substantially encircling said second insulator portion and tightly contacting said second insulator portion and said second shell portion, said metal collar being initially in the form of a metal ring positioned on said second insulator portion prior to insertion of said insulator in said shell, said ring being of a size to contact evenly the inner wall of said shell at the entrance of said third portion of said shell, said ring being formed into said collar during passage of said second insulator portion through said third shell portion; and means within said first shell portion for securing said insulator to said shell.

6. An igniter as claimed in claim 5 wherein said second insulator portion is formed with a circumferential groove and said metal ring is positioned in said groove pior to insertion of said insulator into said shell.

7. An igniter as claimed in claim 6 wherein said metal ring is split along a radius thereof.

8. An igniter as claimed in claim 7 wherein said ring is composed of soft annealed nickel.

* * * * *